US007793518B1

(12) United States Patent
Holleman

(10) Patent No.: US 7,793,518 B1
(45) Date of Patent: Sep. 14, 2010

(54) MAGNETIC CLOTHES GATHERING CLASP

(76) Inventor: Fatin B. Holleman, 25723 Los Cabos Dr., Moreno Valley, CA (US) 92551

( * ) Notice: Subject to any disclaimer, the term of this patent is extended or adjusted under 35 U.S.C. 154(b) by 632 days.

(21) Appl. No.: 11/784,933

(22) Filed: Apr. 10, 2007

Related U.S. Application Data

(60) Provisional application No. 60/791,296, filed on Apr. 12, 2006.

(51) Int. Cl.
*A44C 25/00* (2006.01)

(52) U.S. Cl. ..... 63/33; 63/900; 63/14.1; 63/3.1; 24/303; 2/1

(58) Field of Classification Search ..... None
See application file for complete search history.

(56) References Cited

U.S. PATENT DOCUMENTS

| | | | | | |
|---|---|---|---|---|---|
| 3,034,320 | A * | 5/1962 | Feibelman | ..... | 63/14.1 |
| 3,111,736 | A * | 11/1963 | Budreck | ..... | 24/303 |
| 4,195,492 | A | 4/1980 | Johnson | | |
| 4,281,441 | A * | 8/1981 | Rasner | ..... | 24/700 |
| 4,520,536 | A | 6/1985 | Hata | | |
| 4,912,944 | A | 4/1990 | Crosley et al. | | |
| 5,008,984 | A | 4/1991 | Levy | | |
| 5,050,276 | A * | 9/1991 | Pemberton | ..... | 24/303 |
| 6,640,398 | B2 | 11/2003 | Hoffman | | |
| 6,851,279 | B2 | 2/2005 | Hartgrove | | |
| 2004/0007018 | A1 * | 1/2004 | Detsis | ..... | 63/21 |

* cited by examiner

*Primary Examiner*—Jack W. Lavinder
(74) *Attorney, Agent, or Firm*—Gordon K. Anderson

(57) ABSTRACT

A clothes gathering clasp (10) is provided that is used for gathering and retaining a portion of a clothing garment. The clasp consists of an outside member (20) having a jewelry decorated external surface (22) and an internal surface (24) containing an imbedded a first magnet (26). A chain (40), or other flexible retainer, is attached onto the outside member on one end and to a jewelry decorated inside member (52) on the other. The inside member contains a second magnet (54) imbedded in its internal surface (52). The clasp functions by placing the outside member on an outer surface of a garment then gathering the material with the chain while placing the inside member opposite the outside member on an inner surface of the clothing garment. The portion of the garment gathered with the chain is then retained by the chain in conjunction with the opposed magnets that magnetically bind each other together through the garment material.

6 Claims, 3 Drawing Sheets

MAGNETIC CLOTHES GATHERING CLASP

CROSS REFERENCE TO RELATED APPLICATION

This application claims priority of Provisional Patent Application Ser. No. 60/791,296 filed Apr. 12, 2006.

TECHNICAL FIELD

The present invention relates to clasps in general. More specifically to a clasp having a flexible retainer between two magnetic members for gathering a portion of a garment and retaining the gathered material when the magnetic members are positioned on opposed sides of the garment fabric.

BACKGROUND ART

Previously, many types of clasps or clips using magnets have been used in endeavoring to provide an effective means for removeably holding objects together without damage.

The prior art listed below did not disclose patents that possess any of the novelty of the instant invention; however the following U.S. patents are considered related:

| U.S. Pat. No. | Inventor | Issue Date |
|---|---|---|
| 4,195,492 | Johnson | Apr. 1, 1980 |
| 4,520,536 | Hata | Jun. 4, 1985 |
| 4,912,944 | Crosley et al. | Apr. 3, 1990 |
| 5,008,984 | Levy | Apr. 23, 1991 |
| 6,640,398 B2 | Hoffman | Nov. 4, 2003 |
| 6,851,279 B2 | Hartgrove | Feb. 8, 2005 |

Johnson in U.S. Pat. No. 4,195,492 teaches a post to extend thru the pierced hole in an ear lobe. In one embodiment a post is formed of a magnet including a stop, with the mating opposite post formed of a magnetically attractive material which may be another magnet or metal material.

U.S. Pat. No. 4,520,536 issued to Hata relates to a damper for holding articles of clothing together which consists of a front member, a clamp member and pivot means to hold the members together with a space in between.

Crosley et al. in U.S. Pat. No. 4,912,944 discloses an article of jewelry having a base element which supports an ornamented substrate element thereon by magnetic attraction. Both the base element and the substrate have magnetically attractable properties and at least one of them has the properties of a permanent magnet permitting interchange with other like elements.

Levy in U.S. Pat. No. 5,008,984 teaches a jewelry closure which includes a pair of closure members magnetically engaging together. One or both members include a magnet. A first closure of the pair is supported by a casing which extends outwardly to receive the second closure, with the closure secured with a clip attached to the outer surface of the casing.

U.S. Pat. No. 6,640,398 B2 issued to Hoffman is for magnetic clasps securing the opposite ends of chains and other jewelry. Each clasp includes separable bodies by means of magnets that have been poled to present opposed surfaces.

Hartgrove in U.S. Pat. No. 6,851,279 B2 discloses jewelry articles having magnetic element and interchangeable settings which are magnetically coupled to body portions.

DISCLOSURE OF THE INVENTION

The use of jewelry to enhance the appearance of the human body has been with us since the beginning of time and has changed over the centuries due to the manufacturing techniques. In most cases jewelry has utility in its appearance only however little has been done to utilize its functional nature. The instant invention accomplishes just that in that by the addition of magnets and a flexible retainer, preferably in the form of a chain, between two surface decorated members, similar to pins, pendants or broaches permitting clothing material to be gathered together and held intact by the retainer without penetrating the parent material of the clothing.

It is therefore a primary object of the invention to permit gathering of women's clothing to achieve a different appearance or utility without affecting the garment in any way. As an example a women's blouse, sweater, pullover, shirt, T-top etc. may be altered to a bare midriff style by manually bunching or gathering the material in the front with the retainer and placing the outside member on the front of the garment and the inside member opposite on the inner garment surface. Magnetic attraction, created by opposed dissimilar polarity of the magnets, grips the members together on each side of the material holding the gathered material securely.

An important object of the invention is that the utility is not limited to upper body clothing but is applicable in other areas of attire such as pants or slacks where the length may be shortened by gathering the cuff with the invention not only achieving the desired affect but creating a new and unique visual pleasing style. Sleeves may be shortened in a similar manner or sides of a blouse, swimming suit top etc. with infinite possibilities.

Another object of the invention is in the safety of the device in that no sharp objects penetrate the fabric of the clothing and there is nothing to injure the user or the garment itself.

Still another object is in the variety of uses that are afforded with the invention as the retainer may be removed and the outside member worn as a pin attached by the inside member in the normal manner or visa versa displaying the inside member as a pin. Optionally a top loop may be added to the upper edge of the outside member permitting individual use as a necklace by the addition of a conventional length chain.

These and other objects and advantages of the present invention will become apparent from the subsequent detailed description of the preferred embodiment and the appended claims taken in conjunction with the accompanying drawings.

FIG. $\mathbf{4}^a$ is a cross sectional view of the first magnet $\mathbf{26}_a$.

Figure 5:
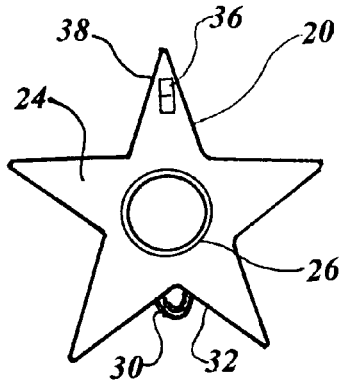
Figure 4A:
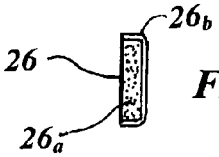

FIG. 5 is a rear view of the outside member completely detached from the retainer for clarity.

Figure 6:
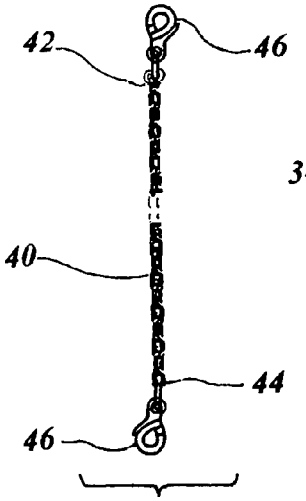

FIG. 6 is a fragmentary front view of the chain completely removed from the invention for clarity.

Figure 7:
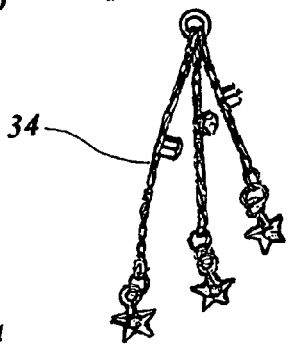

FIG. 7 is a front view of the representative dangles completely removed from the outside member for clarity.

Figure 8:
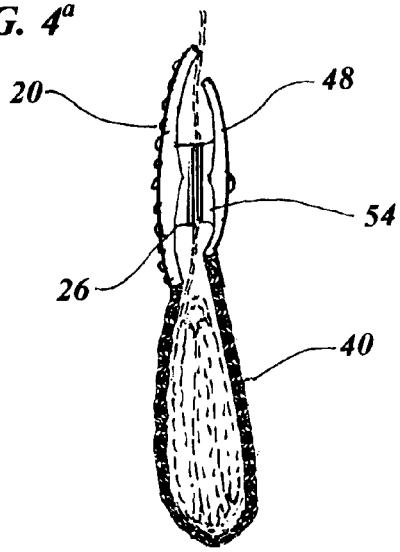

FIG. 8 is a right side view clothes gathering clasp with the magnets attached together through fabric with the gathered fabric illustrated with dashed lines.

Figure 9:
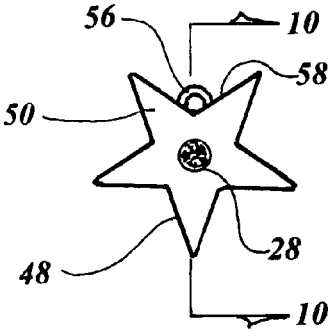

FIG. 9 is a front view of the inside member having a representative jewelry decoration completely detached from the retainer for clarity.

Figure 10:
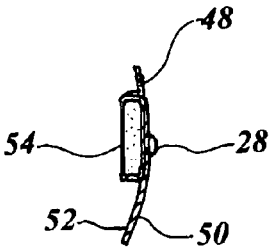

FIG. 10 is a cross sectional view taken along lines 10-10 of FIG. 9

FIG. $\mathbf{10}^{a}$ is a cross sectional view of the first magnet $\mathbf{54}_{a}$.

Figure 11:
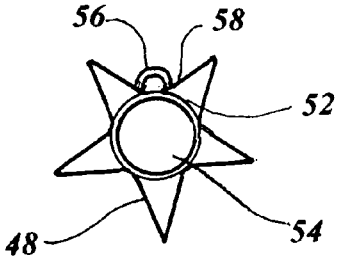
Figure 10A:
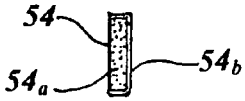

FIG. 11 is a rear view of the inside member having a representative jewelry decoration completely detached from the invention for clarity.

Figure 12:
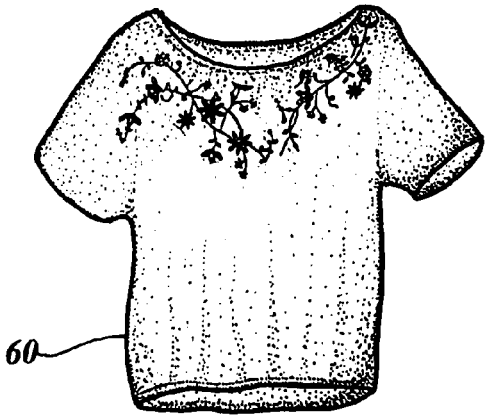

FIG. 12 is a front view of a pullover blouse prior to the use of the invention.

Figure 13:
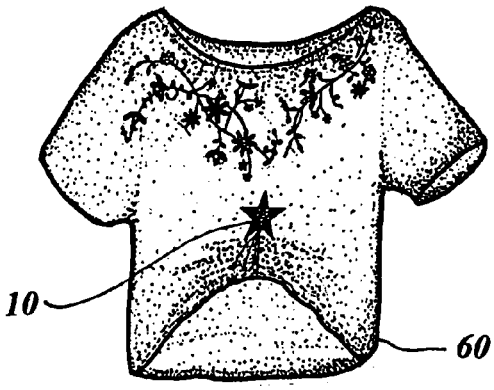

FIG. 13 is a front view of a pullover blouse with the clothes gathering clasp attached gathering the blouse material creating a bare midriff.

Figure 14:
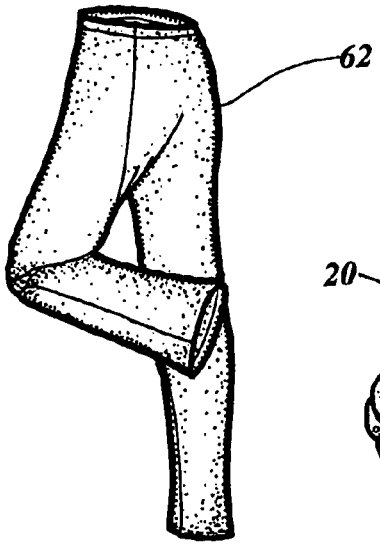

FIG. 14 is a side view of a pair of women's pants prior to the use of the invention.

Figure 15:
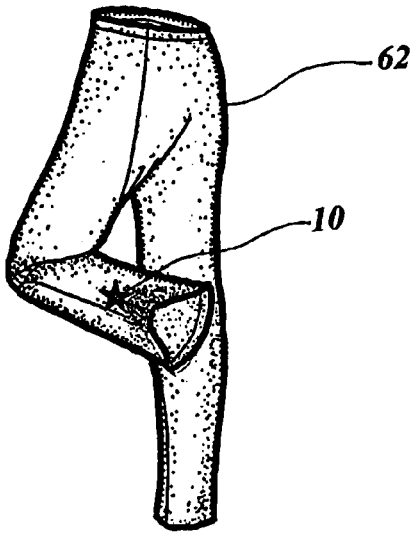

FIG. 15 is a side view of a pair of women's pants with the clothes gathering clasp attached gathering the pant material shortening the length of the leg.

Figure 16:
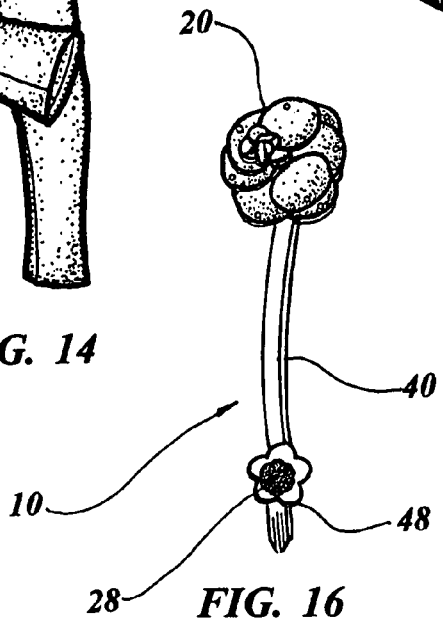

FIG. 16 is a front perspective isometric view of another embodiment of the clothes gathering clasp in fabric with the flexible retainer employing a fabric band.

Figure 17:
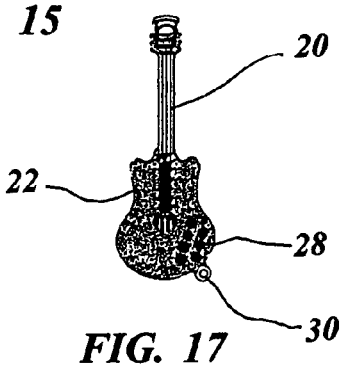

FIG. 17 is a front view of yet another embodiment of the outside member of the clothes gathering clasp in the form of a musical instrument.

BEST MODE FOR CARRYING OUT THE INVENTION

Figure 1:
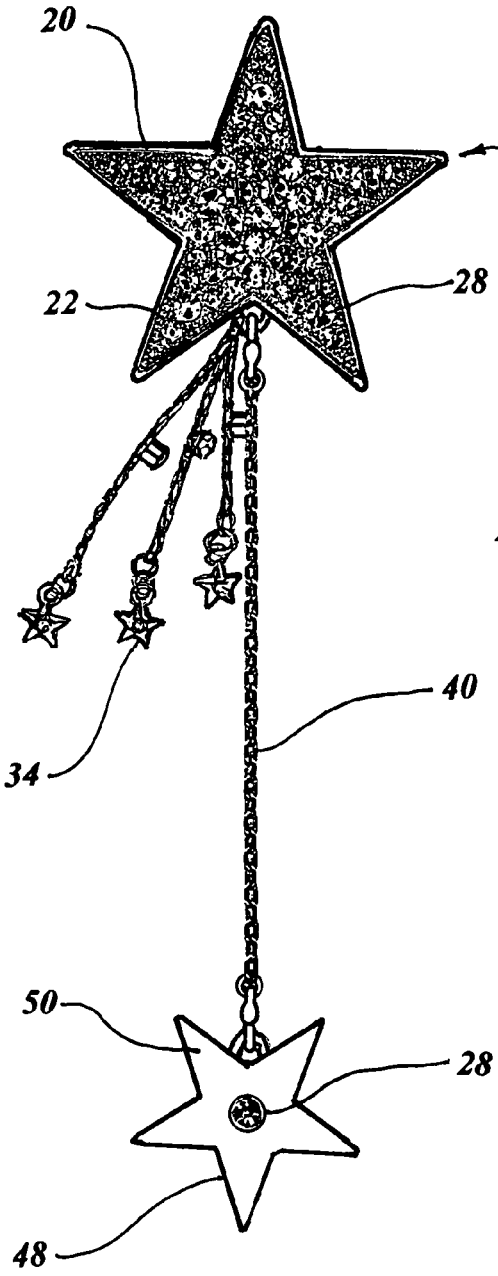
FIG. 1 is a front elevation view of the clothes gathering clasp in the preferred embodiment with representative jewelry decoration.

The best mode for carrying out the invention is presented in terms of a preferred embodiment for a magnetic clothes gathering clasp 10 that is used to gather a portion of a clothing garment. This preferred embodiment is shown in FIGS. 1 thorough 15 and is comprised of an outside member 20 having an external surface 22 and an internal surface 24. The external surface 22 is decorated in jewelry fashion and the internal surface 24 includes a first magnet 26 that is imbedded within the internal surface.

The shape and appearance of the outside member 20 may be any type or style that is appropriate in size and thickness for the application, with FIGS. 1-5 illustrating a star shape which is representative only. There are limitless styles and shapes that may be suitable such as a heart shape, an ornamental geometrical shape, a natural shape replicating flowers, trees, butterflies, animals, musical instruments etc., objects of interest such as crowns, jewels, repetitive designs and a host of others. The outside member external surface 22 may be decorated in jewelry fashion with one or more crystals 28 or other jewelry objects imbedded in or attached to the surface in an ornate manner as illustrated in FIGS. 1, 3, 16 and 17.

Figure 2:
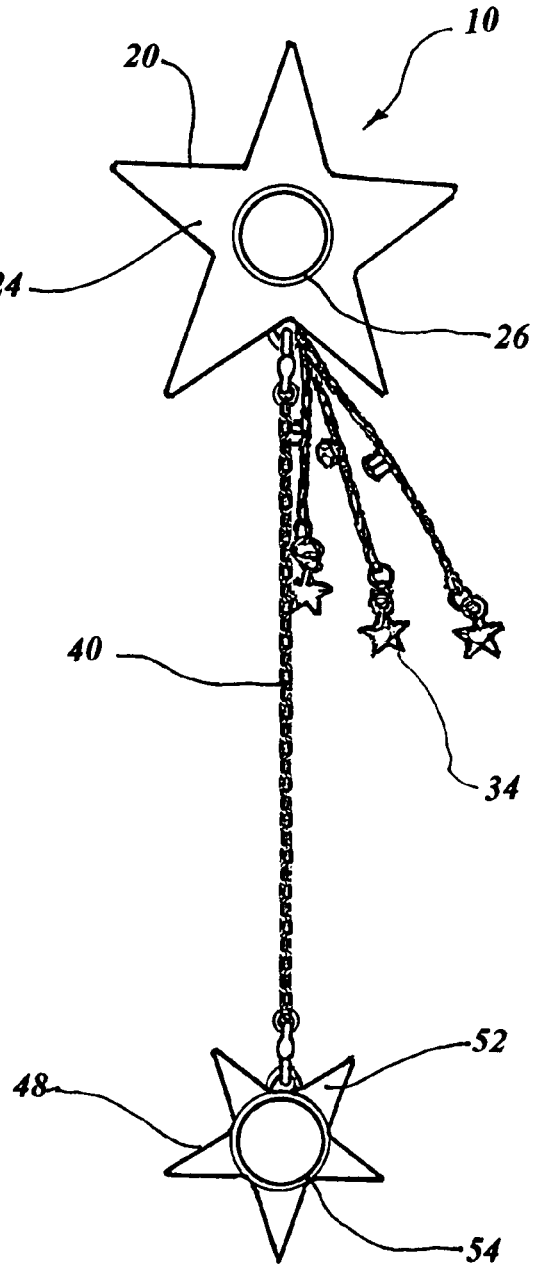
FIG. 2 is a rear elevation view of the clothes gathering clasp in the preferred embodiment.
Figure 3:
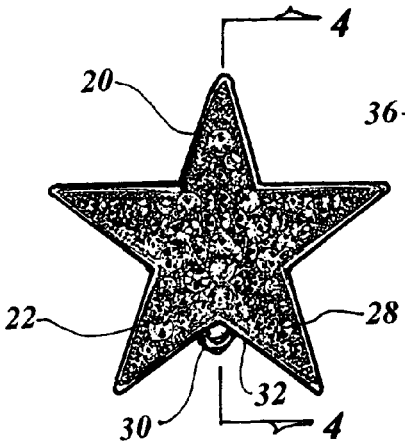
FIG. 3 is a front view of the outside member having a representative jewelry decoration completely detached from the retainer for clarity.
Figure 4:
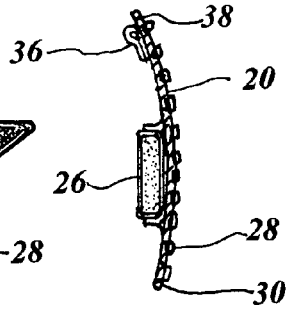
FIG. 4 is a cross sectional view taken along lines 4-4 of FIG. 3.

The outside member 20 may include a bottom loop 30 integrally formed adjacent to a lower edge 32, for attachment purposes. Optionally a number of ornamental chained dangles 34, or other hanging decorations, may be collectively disposed on the outside member bottom loop 30, as shown in FIGS. 1 and 2.

The outside member 20 of the clothes gathering clasp 10 is preferably formed of rhodium material with the crystals 28 imbedded in the external surface 22 made of glass. The rhodium material is preferably plated with a metal such as gold or silver or a material replicating similar visual qualities. An alternate embodiment may be made of fabric or a similar material simulating an object such as the flower illustrated in FIG. 16.

An optional auxiliary top loop 36 may be integrally formed adjacent to an upper edge 38 for attachment of a neck chain thereby converting the outside member 20 to a pendant when dissembled and used singularly.

The first magnet 26 preferably has a magnetic strength rating of at least 10 kilogausses in order to function ideally. The preferred type of magnet is formed of neodymium rare earth element $\mathbf{26}_{a}$, however, other types may also be used provided they equal or exceed the strength rating required. It has been found by trial and error that the optimum size of the first magnet 26 has a nominal diameter of 0.500 inch (1.27 cm) with a nominal thickness of 0.125 inch (0.318 cm) and is covered with a nickel plated metal sheet steel enclosure $\mathbf{26}_{b}$ and axially magnetized. While the magnet 26 preferred is round and is the so called disc or button type, other shapes and sizes may also be utilized as acceptable alternates.

A flexible retainer is utilized selected from the group consisting of a chain, a rope, a string, a thread, a band, a strip of material, webbing and a wire. While all of the above will function properly in the invention it is preferred that a chain 40 be utilized, therefore from here onwards only a chain 40 will be described without eliminating the other possibilities. The preferred chain 40 is further described having a first end 42 and a second end 44 with the first end 42 attached to the outside member 20 onto the bottom loop 30 preferably in a removable manner. The length of the chain 40 end to end has been determined by extensive testing to be from 3.90 to 4.10 inches (9.90 to 10.41 cm) with 4.00 inches (10.16 cm) the ideal preferred length. Since there is tensile strength required to hold the gathered material in place it is preferred that the chain incorporates welded links which are in common usage in the jewelry art. Therefore a metallic chain 40 having from 10 to 12 links per inch (25 to 30 links per cm) with a material diameter of from 0.025 to 0.030 inches (0.063 to 0.0762 cm) is preferable. The chain 40 may be plated to match the balance of the clasp 10. In order for the chain 40, or any other retainer material, to be removable an open eye snap 46 may be connected to the chain 40 on the chain's first end 42 and second end 44, as illustrated in FIG. 6.

To complete the clasp 10 an inside member 48 is removably attached to the chain 40 on its second end 44 with this inside member 48 having an external surface 50 and an internal surface 52. The external surface 50 of the inside member 48 may be decorated in jewelry fashion and the internal surface 52 incorporates an embedded second magnet 54.

The shape and appearance of the inside member 48 may be any type or style that is appropriate to be compatible with the outside member 20, with FIGS. 1, 2 and 7-11 illustrating a representative star shape. It may be an advantage to have the outside member 20 larger in size than the inside member however, it is feasible to conversely have both members be the same size or even reversed in size relationship.

The inside member external surface 50 may decorated in jewelry fashion with at least one crystal 28 imbedded in the external surface 50 in an ornate location or simply unadorned in its external surface. It is also anticipated that the inside member may be an exact duplicate of the outside member 20, in miniature or it could be completely different in not only its shape and size but in all other aspects. The inside member 48 incorporates a top loop 56 integrally formed adjacent to an upper edge 58 for attachment of the length of chain 40.

The second magnet 54 is preferably a duplicate of the first magnet 26 also having a magnetic strength rating of at least 10 kilogausses and may be formed of neodymium rare earth element $\mathbf{54}_{a}$ covered with a nickel plated metal sheet steel enclosure $\mathbf{54}_{b}$. The size of the second magnet 54 is the same having a nominal diameter of 0.500 inch (1.27 cm) and a nominal thickness of 0.125 inch (0.318 cm). It is also understood that the inside member 48 may be fabricated of a magnetisable material eliminating the need for a discrete magnet.

FIG. 16 illustrated another embodiment of the clothes gathering clasp 10 which is made of a non-metallic fabric material which encloses the magnet and but still employs crystals as the jewelry decoration on its exterior surface.

The invention functions as a clothes gathering clasp 10 as follows; when the outside member 20 is placed on an outer surface of a garment, and gathered with the chain 40, and the inside member is juxtapositioned with the outside member on an inner surface of the clothing garment, the portion of the garment gathered with the chain 40 is retained in concert with the chain 40 and the magnetic attraction created by the opposed dissimilar polarity of the magnets 26 and 54.

FIG. 8 illustrates the clasp 10 looped over the gathered clothing shown in dashed lines. FIG. 12 depicts a representative blouse 60 with FIG. 13 illustrating the same blouse 60 with the material of the blouse gathered and held securely with the clasp 10. Likewise FIG. 14 shows a pair of pants 62 and FIG. 15 with the pants legs gathered with the clasp 10 which doubly serves to shorten the pants legs.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ELEMENT DESIGNATION

For Convenience of the Examiner, not Part of the Specification

10 magnetic clothes gathering clasp
20 outside member
22 external surface (of 20)
24 internal surface (of 20)
26 first magnet
28 crystals
30 bottom loop (on 20)
32 lower edge (of 20)
34 dangles
36 auxiliary top loop
38 upper edge (of 20)
40 chain
42 first end (of 40)
44 second end (of 40)
46 open eye snaps
48 inside member
50 external surface (of 48)
52 internal surface (of 48)
54 second magnet
56 top loop (on 48)
58 upper edge (of 48)
60 blouse
62 pants

The invention claimed is:

1. A clothes gathering clasp for gathering and retaining a portion of a garment which comprises:

an outside member having an external surface and an internal surface with said external surface decorated and said internal surface having a first magnet imbedded therein, wherein said outside member external surface decorated further comprises a plurality of jewelry crystals imbedded in said external surface in an ornate manner, wherein said outside member further having a bottom loop integrally formed adjacent to a lower edge for attachment purposes, a flexible retainer having a first end and a second end with the first end attached to the outside member in a removable manner, an inside member removably attached to the second end of the flexible retainer with said inside member having an external surface and an internal surface with said internal surface having a second magnet imbedded therein, such that when the outside member is placed on an outer surface of a garment, and gathered with the flexible retainer, and the inside member is juxtapositioned with the outside member on an inner surface of the clothing garment, the portion of the garment gathered with the flexible retainer is retained with a magnetic attraction created by opposed dissimilar polarity of the magnets, wherein said inside member further having a top loop integrally formed adjacent to an upper edge for attachment of said flexible retainer, wherein said first magnet and said second magnet have a nominal diameter of 0.500 inch (1.27 cm) with a nominal thickness of 0.100 inch (0.254 cm) and are enclosed with a nickel plated metal sheet steel enclosure, and wherein said outside member is larger in size than said inside member.

2. The clothes gathering clasp as recited in claim 1 wherein said outside member further having an auxiliary top loop integrally formed adjacent to an upper edge for attachment of a neck chain converting the outside member to a pendant.

3. The clothes gathering clasp as recited in claim 1 further comprising a plurality of ornamental chained dangles collectively disposed on said outside member bottom loop.

4. The clothes gathering clasp as recited in claim 1 wherein said flexible retainer is selected from the group consisting of a chain, a rope, a string, a thread, a strip of material, webbing and a wire.

5. The clothes gathering clasp as recited in claim 4 wherein said chain incorporates welded links and is plated to match said outside member and inside member.

6. The clothes gathering clasp as recited in claim 1 wherein said flexible retainer further comprises an open eye snap on the first end and an open eye snap on the second end.

* * * * *